United States Patent [19]

Peluso

[11] 4,423,698

[45] Jan. 3, 1984

[54] DIVING BOARD AND BRACKET ASSEMBLY FOR A BOAT

[76] Inventor: Nicholas Peluso, 210 Belvedere Dr., Massapequa Park, N.Y. 11762

[21] Appl. No.: 316,565

[22] Filed: Oct. 30, 1981

[51] Int. Cl.[3] ..... B63B 17/00

[52] U.S. Cl. ..... 114/343; 272/66

[58] Field of Search ..... 114/343, 362; 4/496; 272/66; 248/235; 411/538

[56] References Cited

U.S. PATENT DOCUMENTS 2,594,459 4/1952 Larson, Jr. ..... 272/66

3,794,140 2/1974 Sell ..... 114/362

FOREIGN PATENT DOCUMENTS 532663 1/1941 United Kingdom ..... 411/538

*Primary Examiner*—Sherman D. Basinger

*Attorney, Agent, or Firm*—Allison C. Collard; Thomas M. Galgano

[57] ABSTRACT

A diving board and bracket assembly for a boat which includes a generally rectangular diving board, a bracket having a generally rectangular slot for receipt therein of an end of the diving board, a fastening device for releasably securing the diving board to the bracket and a fastening device for securing the bracket to a boat. The diving board is specifically intended for mounting on a transom of a boat and an adjustment device is provided for accommodating various transom angles.

4 Claims, 4 Drawing Figures

FIG. 4
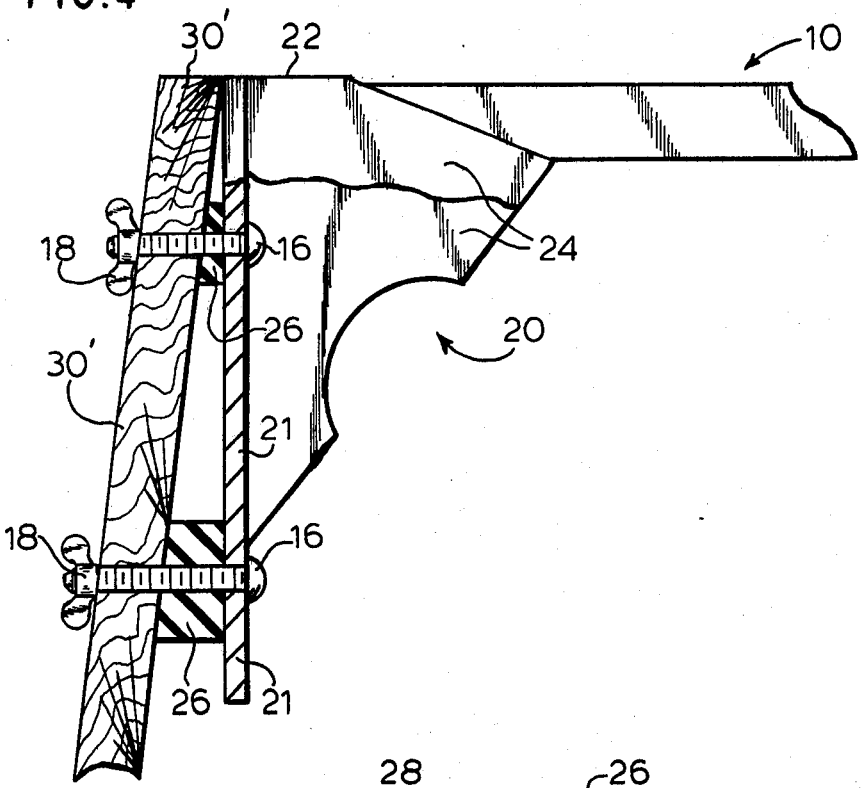
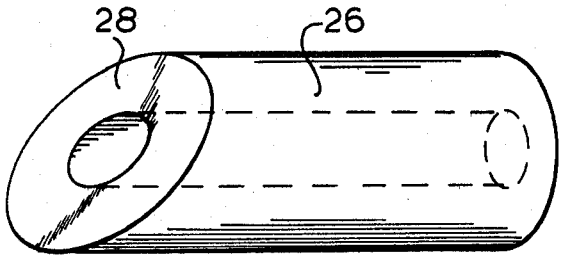
FIG. 3

DIVING BOARD AND BRACKET ASSEMBLY FOR A BOAT

FIELD OF THE INVENTION

The present invention relates to a diving board and bracket assembly intended for use with boats. More particularly, it relates to such diving board and bracket assembly which is intended to be mounted on the transom of boats.

BACKGROUND OF THE INVENTION

A multitude of boat accessories are well known and widely used. However, so far as is known, no one has proposed mounting a diving board on a boat for additional enjoyment. With most pleasure boats, when one wants to take a swim, he simply dives off of the gunwale of the boat into the water. However, most gunwales are typically quite narrow and there is a possibility that the diver might slip and seriously hurt himself.

Accordingly, it is an object of the present invention to provide a novel diving board and bracket assembly for a boat.

It is a further object of the present invention to provide such a novel diving board and bracket assembly which is of relatively simple construction, easy to use and economical to fabricate.

It is a more particular object of the present invention to provide such a novel assembly which allows easy and quick mounting and dismantling of the diving board and which also accommodates a large range of transom angles.

SUMMARY OF THE INVENTION

Certain of the foregoing and related objects are readily attained according to the present invention by a diving board and bracket assembly for a boat which includes a generally rectangular diving board, a bracket having a generally rectangular slot for receipt therein of an end of the diving board, means for detachably securing the diving board to the bracket, and means for securing the bracket to the boat.

Preferably, the bracket has a pair of spaced-apart generally upstanding parallel side walls, a pair of horizontally-disposed, spaced-apart, parallel support walls joined to and extending between the side walls to define, in cooperation therewith, the rectangular slot, and a back wall to which the side walls and support walls are secured.

Most advantageously, the board has at least one mounting bore extending vertically therethrough adjacent to the "one" end thereof, and the lower support wall is also provided with a through bore disposed for vertical alignment with the mounting bore of the diving board. The means for securing the bracket to the boat desirably comprises a bolt insertable through said bores of the diving board and the lower support wall and a nut securable to the end of the bolt for securely fastening the diving board on the bracket. Preferably, the back wall of the bracket is also secured to the boat by means of a nut and bolt assembly.

To accommodate various boat transom angles, a hard rubber bushing having an angular end face configured to complement the angle of the transom may be used. It is placed on the bolt between the back plate bracket and the transom with its angled face in flush abutment with the transom, whereby the diving board will be maintained in a substantially horizontal disposition when mounted on the bracket.

BRIEF DESCRIPTION OF THE DRAWINGS

Other objects and features of the present invention will become apparent from the following detailed description considered in connection with the accompanying drawings which disclose one embodiment of the invention. It is to be understood that the drawings are to be used for the purposes of illustration only, and not as a definition of the limits of the invention.

In the drawings, wherein similar reference characters denote similar elements throughout the several views:

FIG. 3 is an enlarged perspective view showing the rubber bushing used to accommodate various transom angles; and FIG. 4 is a side sectional view similar to that of FIG. 2, but showing the rubber bushing mounted in place to accommodate the boat transom angle.

DETAILED DESCRIPTION OF THE PREFERRED AND ILLUSTRATED EMBODIMENT

Figure 1:
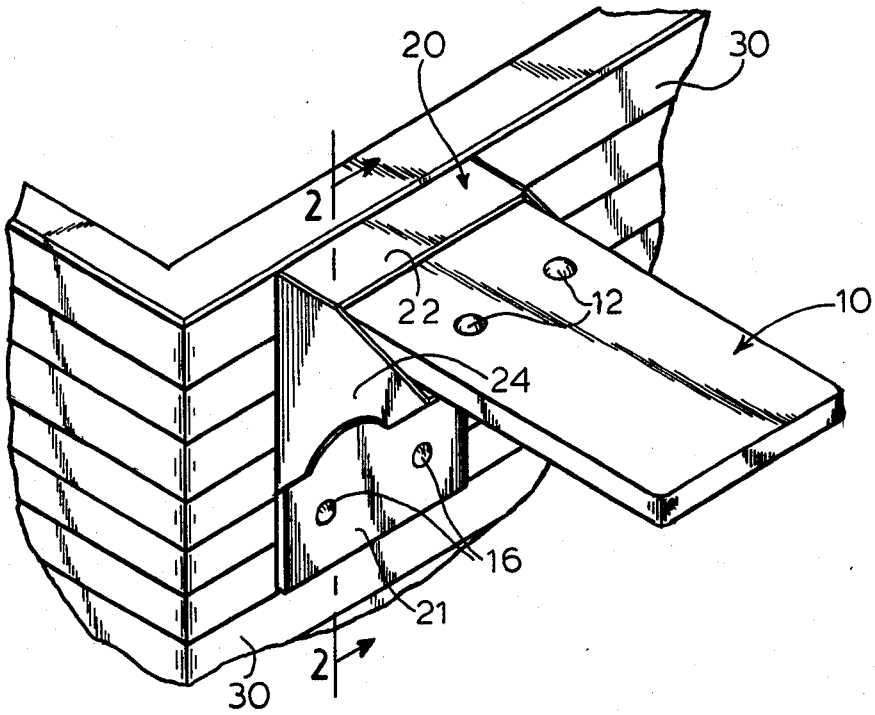
FIG. 1 is a fragmentarily-illustrated, perspective view showing a novel diving board and bracket assembly embodying the present invention mounted on the transom of a boat.

Turning now in detail to the drawings, and in particular, FIG. 1 thereof, therein illustrated is a novel diving board and bracket assembly for a boat which basically includes a diving board 10 and a bracket 20 supporting the diving board 10 which is mounted on the transom 30 of a boat. The diving board 10 is generally of standard construction, although a rather short rectangular board is provided.

Bracket 20 includes a vertically-disposed generally rectangular back plate 21, a horizontally-disposed generally rectangular top support plate 22 secured to the top edge of back plate 21, a horizontally-disposed bottom support plate 23 spaced parallel to and beneath top support plate 22 and joined to back plate 21, and a pair of side walls or side braces 24 which are joined to opposite lateral edges of back plate 21, top plate 22, and bottom plate 23. Plates 21, 22 and 23 are so dimensioned and arranged that they define a rectangular slot in which diving board 10 may be slid.

Figure 2:
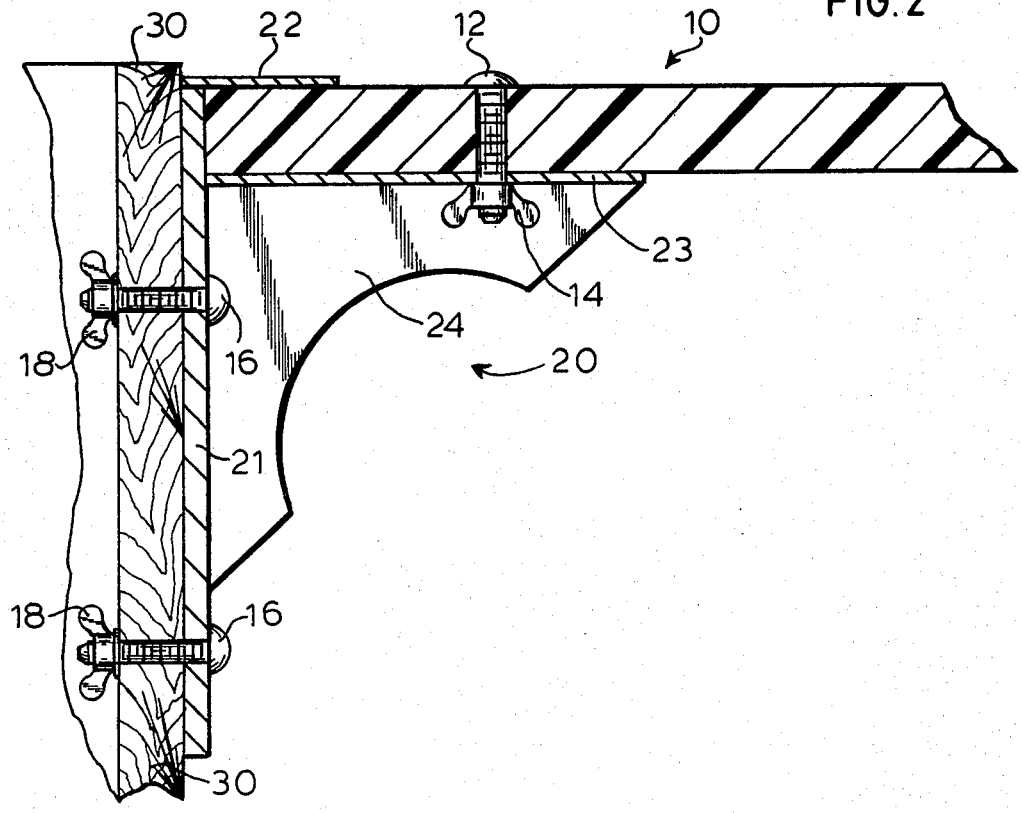
FIG. 2 is a sectional view taken along line 2—2 of FIG. 1.

Diving board 10 is securely affixed to bracket 20 by a pair of threaded bolts 12 which extend through two laterally, spaced-apart vertically-extending through bores or mounting holes (only one of which is shown in FIG. 2) provided adjacent to the inner end thereof of the diving board 10 and similarly dimensional and aligned holes in bottom support plate 23, bolts 12 are secured in place by means of butterfly nuts 14. Similarly, back plate 21 is secured to boat transom 30 by means of four bolts 16 which are inserted through mounting holes in the back plate and the transom and are secured by butterfly nuts 18 as well.

Not all boats have perfectly upright transoms as shown in FIG. 2, but instead they may have an angled transom as shown in FIG. 4. In such cases, a hard rubber bushing 26 such as shown in FIG. 3, may be used to accommodate the particular transom angle. The bushing is provided with an end face 28 which is angled to accommodate the angular disposition of the angled transom 30' as illustrated in FIG. 4. These properly angled bushings are mounted on the mounting bolts 16 between the boat transom 30' and the back plate 21 with its angled face 28 abutting the boat transom surface. In this way, the vertical disposition of back plate 21 and, in turn, the horizontal disposition of the diving board 10 is maintained.

As can be appreciated, in order to install bracket 20, one would have to simply provide for mounting holes in the transom for effecting mounting of the back plate 21 of bracket 20. The end face of the hard rubber bushings 26, if needed, could be angled to accommodate the boat transom by use of a knife or other sharp implement. Once installed, bracket 20 would, in fact, become a permanent fixture of the boat. The diving board, on the other hand, would be secured in place only when desired. When not in use, the same would be removed by removal of bolts 12 and nuts 14 and stored in a suitable, out-of-the-way place on the boat.

As can be appreciated, various modifications and changes may be made as will be apparent to those skilled in the art. For example, the diving board and the bracket may be made from a wide range of materials. In addition, the configuration of the bracket may be modified as long as the structural relationships for the support of the swimming board and for mounting the bracket on the transom of the boat are maintained. Moreover, other fasteners could also be possibly used.

Thus, while only one embodiment of the present invention has been shown and described, it is obvious that many changes and modifications may be made thereunto without departing from the spirit and scope of the invention.

What is claimed is:

1. A diving board and bracket assembly for a boat comprising:

a generally rectangular diving board having at least one mounting hole extending vertically therethrough adjacent to one end thereof;

a bracket having a generally rectangular slot for receipt therein of an end of said diving board, said bracket having a pair of spaced-apart, generally upstanding, parallel sidewalls, and a pair of generally horizontally disposed, spaced-apart, parallel, upper and lower support walls joined to and extending between said sidewalls to define, in cooperation therewith, said rectangular slot, as well as a back wall to which at least one of said sidewalls and said support walls is secured, said upper support wall having a width which is less than said lower support wall, the latter of which is provided with at least one mounting hole vertically extending therethrough and disposed for alignment with the hole in said diving board when said diving board is inserted into said rectangular slot;

means for detachably securing said board to said bracket so as to allow relatively quick securement and detachment of said board to said bracket; and means for securing said bracket to a boat in a relatively permanent manner.

2. The assembly according to claim 1, wherein said means for detachably securing said board to said bracket comprises a bolt receivable through said mounting holes, and a nut securable on the end of said bolt for securely fastening said diving board to said mounting bracket.

3. The assembly according to claim 1, wherein said back wall has at least one mounting hole formed therethrough, and wherein said means for securing said bracket to a boat comprises a bolt receivable through said mounting hole of said back wall, and a corresponding mounting hole in the boat, and a nut for securement on the end of the bolt for fastening the bracket to the boat.

4. The assembly according to claim 3, wherein said means for securing said bracket to said boat additionally includes a tubular bushing received on said bolt having an angled end face.

* * * * *